US005612117A

United States Patent [19]

Bélanger et al.

[11] Patent Number: 5,612,117

[45] Date of Patent: Mar. 18, 1997

[54] CORE-BOARD

[75] Inventors: Germain Bélanger, St-Germain-de-Grantham; Pierre Larivière, Roxton Falls; Normand Labonté , Richmond; Bruno Archambault, Richmond; Bruno St-Sauveur, Richmond, all of Canada

[73] Assignee: Baultar Composite Inc., Richmond, Canada

[21] Appl. No.: 437,657

[22] Filed: May 9, 1995

[30] Foreign Application Priority Data

Mar. 9, 1995 [CA] Canada ..... 2144295

[51] Int. Cl.[6] ..... B32B 3/12; E04C 2/32

[52] U.S. Cl. ..... 428/178; 428/72; 428/76; 428/166; 428/172; 428/174; 428/118; 52/793.1; 52/789.1; 52/794.1

[58] Field of Search ..... 428/182, 178, 428/72, 76, 156, 166, 172, 174, 289, 292, 118, 913; 52/793.1, 789.1, 794.1

[56] References Cited

U.S. PATENT DOCUMENTS

| | | | |
|---|---|---|---|
| 1,984,653 | 12/1934 | Palmer et al. | 428/178 |
| 2,809,908 | 10/1957 | French | 428/180 |
| 3,622,430 | 11/1971 | Jurisich | 428/118 |
| 3,940,811 | 3/1976 | Tomikawa | 428/178 |
| 4,025,996 | 5/1977 | Saveker | 428/178 |
| 5,156,327 | 10/1992 | Takahashi | 428/178 |
| 5,242,735 | 9/1993 | Blankenburg | 428/178 |
| 5,266,379 | 11/1993 | Schaeffer | 428/174 |

*Primary Examiner*—Donald Loney
*Attorney, Agent, or Firm*—Robic

[57] ABSTRACT

Disclosed is a core for use in a core-board, which consists of an embossed sheet of a light weight material comprising a central surface extending in a plane and a plurality of embossments called top and bottom cells, that are identical in shape and project from the central surface on both sides thereof. Each of the top and bottom cells is integral to the central surface and of pyramidal shape. Each of them also has an open base of regular hexagonal shape extending in the plane of this central surface and a top flat surface of regular hexagonal shape and of a smaller surface area than the base. These top and bottom cells are regularly distributed onto the central surface in such a manner that each top cell is not adjacent to another top cell but extends edge to edge to three spaced apart bottom cells, and each bottom cell is not adjacent to another bottom cell, but extends edge to edge to three spaced apart top cells. The core-board incorporating this core is particularly strong and resistant to compression, tear-out and shear forces. Moreover, anchors can be inserted in it at any desired location.

17 Claims, 3 Drawing Sheets

CORE-BOARD

BACKGROUND OF THE INVENTION a) Field of the Invention

The present invention relates to a core-board of improved structure, which is particularly well, although not exclusively, designed for use as a floor panel in a railroad wagon.

The invention also relates to the core used in this core-board, and to the way such core-board may easily yet efficiently anchored and/or rigidly connected edge-to-edge to adjacent core-boards.

b) Description of the Prior Art

Core-boards (also known as sandwich panels) are well known products. As shown in FIG. 1 which is illustrative of the prior art, the most conventional core-boards comprise a core 53 usually of honey-comb structure that is sandwiched between two flats outer panels 55, 57, hereinafter called "skins", that are glued to the core. Depending on the application, the core can be made of a composite material or another light weight material such as aluminum. Similarly, the skins can be made of any desired material.

If these known core-boards are very strong and resistant to compression forces applied in the direction shown with the arrows A in FIG. 1, they are rather weak when shearing forces are applied to them in the directions shown with the arrows B in the same Figure.

To overcome this deficiency, it has already been suggested to use cores that are tridimensional and consist of a thin panel having a plurality of bosses or cells of identical or different shapes, that project from both sides thereof. See, for examples, U.S. Pat. Nos. 2,809,908; 3,622,430; 3,940,811; 4,025,996; 5,156,327; 5,242,735 and 5,266,379. The cores disclosed in these patents overcome at least in part the above mentioned deficiency of the honey-comb shaped cores. However, they are still open to improvements.

It is also of common practice to use core-boards as floorings in cars or locomotives in the railway industry. To be efficient for such application, the core-boards must satisfy a plurality of very specific requirements.

First of all, the core-boards must be structural and have thermic insulation properties that meet with the very specific provisions of the flame exposition duration standard ASTM E 119.

The core-boards must also be of such a design that one may cut them as wanted to install them whenever required in a wagon.

The core-boards must further be strong enough to be bolted onto the frame of a railroad car and to allow fixation of passenger seats.

The core-boards must be capable of receiving an anti-skidding surface coating.

Last of all, the core-boards must be light, rigid and strong enough to resist the stresses to which any car flooring is subjected. In the meantime, they must also be economically competitive with the presently available materials.

It is quite obvious that the critical element of any core-board is the core of it. Indeed, for a very specific application like the one mentioned above the core must satisfy the following requirements:

High compression and tension resistance;

High shearing and impact resistance;

High rigidity and low fragility;

High thermic resistance;

Excellent flexion, vibration and stress resistance;

High dimensional stability under thermic or chemical stresses;

Minimum crack growth during cutting or piercing;

Lightness, rapidity of assembly and dimensional uniformity; and

Simple yet versatile geometry.

Researches carried out by the Applicant to find a core-board geometry allowing installation of the same without any limitation on any kind of supporting car frames, have shown that core-boards having cores of the molded or formed type are capable of satisfying the above-mentioned requirements. These cores are made by molding of a polymer resin with a reinforcing material such as fibers. Such cores advantageously allow the insertion of inserts for anchoring purpose.

In this connection, it is worth reminding that among all the characteristics that a core-board must satisfy to be useful as a car flooring, its ability to receive anchors is a very important one. Indeed, the cantilever force applied by the passenger seats onto the anchors inserted into the flooring in the case of an impact may cause the core-board to be torn out of the frame of the wagon to which it is connected.

Under such conditions, a shearing effect may be generated, which may cause the opposite skins of the core-board to delaminate, especially if the fixation of the core-board to the frame has not been made with bolts passing through the entire thickness of the core-board.

Accordingly, there is presently a need for a core-board which not only would satisfy the above mentioned requirements but also would allow anchoring of the same to a supporting frame or anchoring of equipments such as passenger seats onto the core-board in an efficient, shear resistant manner while avoiding the formation of thermal bridges.

OBJECTS AND SUMMARY OF THE INVENTION

An object of the invention is to provide a core of improved structure, which, when incorporated between two opposite skins of conventional structure, forms a core-board that meets the above-mentioned requirements.

Another object of the present invention is to provide a core-board of improved structure, which incorporates the above core and meets each of the above-mentioned requirements, making it a particularly useful as a floor panel in a railroad wagon although it can also be used for other applications, such as in the manufacture of wall panels, containers, etc.

The core according to the invention consists of an embossed sheet of a light weight material comprising:

a central surface extending in a plane;

a plurality of embossments hereinafter called "top cells", that are identical in shape and project from the central surface on one side thereof; and another plurality of embossments hereinafter called "bottom cells", that are identical in shape and project from the central surface in a direction opposite to the top cells.

Each of the top and bottom cells is integral to the central surface and of pyramidal shape and has an open base of regular hexagonal shape extending in the plane of the central surface, a top flat surface that is of regular hexagonal shape and of a smaller surface area than the base, this top flat surface extending parallel to the plane, and six tapering side surfaces joining the top surface of the cell to the central surface of it.

The bases of the top and bottom cells are of a same size.

Moreover, the top and bottom cells are regularly distributed onto the central surface in such a manner that each top cell is not adjacent to another top cell but extends edge to edge to three spaced apart bottom cells, and each bottom cell is not adjacent to another bottom cell but extends edge to edge to three spaced apart top cells, each of the top and bottom cells being thus spaced apart from the other top and bottom cells respectively by portions of the central surface that are of hexagonal shape and of the same size as the bases of the top and bottom cells.

Advantageously, the top and bottom cells are identical in size and height, whereby the central surface extends at mid-distance between the top surfaces of the top cells and the top surfaces of the bottom cells.

The core according to the invention is preferably made by compression molding of a laminated fabric made of thermoset resin and fibers. This fabric must of course be flexible and elastic enough to allow the core to be molded in a compression mold. The core according to the invention can also be made by resin transfer molding. In such a case, the fibers are inserted first in the mold; then, the mold is closed and the resin is injected. The core according to the invention can further be made from a prepeg inserted into a mold heated according to a given cycle. In all cases, it is of the uppermost importance to position the fabric (or the fibers when use is made of loosen fibers) in such a manner that these fibers extend perpendicular to the edges of the base of each cell. It is also important that such fibers be stretched during the molding step so as to remain under tension when the thermoset resin is cured. Such a feature substantially improves the strength of the core.

The core-board according to the invention comprises a core of the above-mentioned structure, which is sandwiched between a pair of opposite skins that are parallel to each other. These skins are connected to the core by fixation of the top surfaces of the top and bottom cells of the core to the inner surfaces of the skins, respectively. In this connection, the skins of the core-board can be fixed to the core in any suitable manner such as, for example, by gluing or spot-welding or with bolts or rivets.

The core-board may comprise anchoring means to allow fixation thereof to a support or fixation of a piece of equipment thereto by screws or bolts. Such anchoring means may comprise inserts introduced into holes made in one of the opposite skins at any desired location, the inserts being held in position by a syntactic foam injected into the core so as to embed the inserts.

The internal cavity defined by the cells of the core can be filled up with a cellular thermic insulation material in order to improve the thermal resistance of the core-board and to avoid thermal bridges.

Therefore, the core-board according to the invention has the following advantages:

- it is of modular structure and easy to manufacture;
- it is very strong and resistant to compression, tear-out and shear forces;
- it is also very resistant to torsion and vibration;
- anchoring means can be inserted therein at any desired location;
- the distance between the anchoring means can be very short;
- cutting of it is quite easy to do.

Because of their very specific shape and their relative positions with respect to each other, none of the cells of a given category (top or bottom) is directly adjacent to another cell of the same category.

It is not compulsory that the number of cells of one category be necessarily equal to the number of cells of the other category. As a matter of fact, for some very specific applications, the number of, for example, top cells could be up to 30% higher or lower than the number of bottom cells (and vice-versa). Such an assymetry could, at first sight, be considered as a problem. However, it has been found that such is not the case because when, for example, the core-board according to the invention is used as a floor panel in a railroad wagon, it is always subject to a loading which causes its upper skin to be under compression and the opposite, lower skin to be under tension. Therefore, the core-board could be mounted so that its anchoring points are oriented towards the lower skin, thereby allowing fixation of the core-board to a bearing structure by the skin which is opposite to the one subject to the maximum stress.

This particular feature could also be used in the other way, if one wants a maximum support for the upper skin of the core-board, i.e. when important vertical loads may be distributed on it in an aleatory manner. In such a case, the core-board could be inverted and would offer a maximum support.

As aforesaid, the cavity within the core-board can be filled up with an insulation material, preferably a syntactic foam or a similar material having a low expansion force, such as a urea formaldehyde foam. Such a filling can be carried out during or after manufacture of the core-board. In practice, use is preferably made of a syntactic foam which does not need to have a high density, since the core is already strong enough. The main advantage of using a low density syntactic foam is that this avoids the addition of too much weight while achieving the requested thermal resistance. In addition, there is also other advantage of using a syntactic foam: such foam is known to have good structural properties and can be used to structurally reinforce the core-board to allow a reduction in the thickness of the skins.

Thanks to their particular geometry and position, the cells of the core-board according to the invention can very easily be filled up with the foam. As a matter of fact, the core-board can even be premolded with syntactic foam within its cells before fixation to it of the opposite panels.

The invention and its advantages will be better understood upon reading the following non-restrictive description of a preferred embodiment thereof, made with reference to the accompanying drawings.

DESCRIPTION OF A PREFERRED EMBODIMENT OF THE INVENTION

Figure 1:
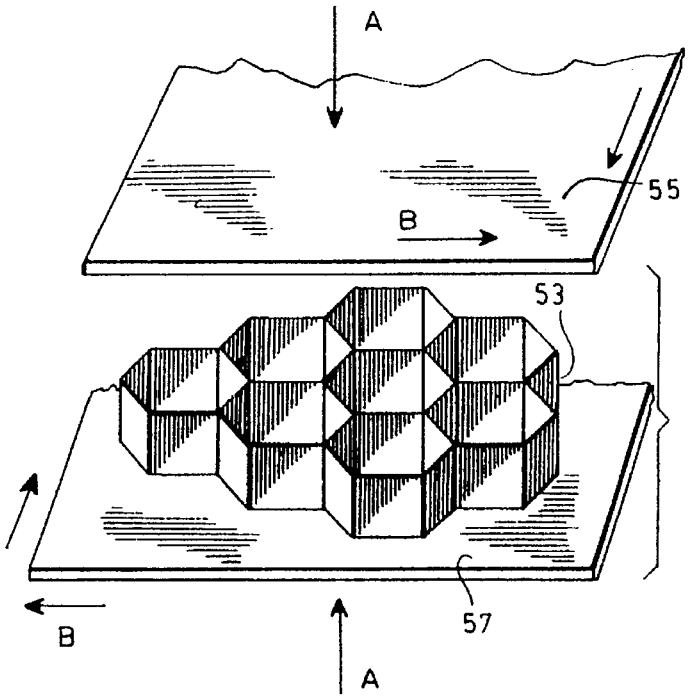
FIG. 1 (PRIOR ART)
FIG. 1 is an exploded perspective view of a prior art core-board of honeycomb structure.
Figure 2:
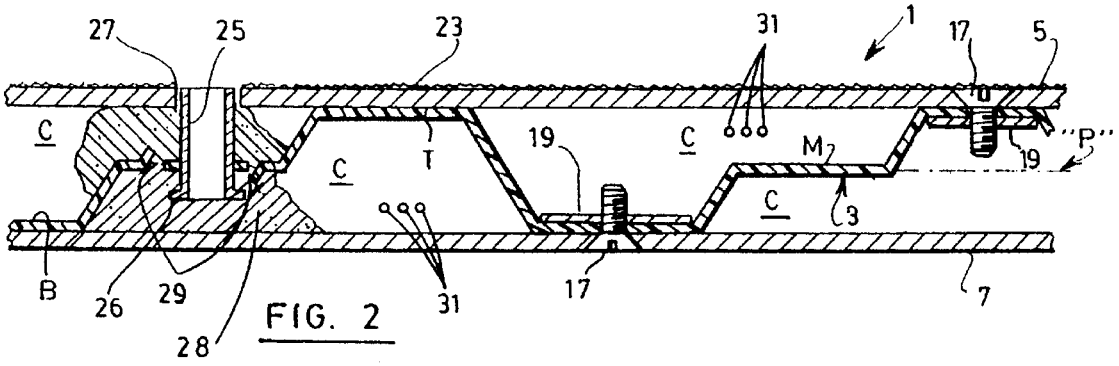
FIG. 2 is a side elevational, cross-sectional view of a core-board according to the invention, incorporating an insert.
Figure 3:
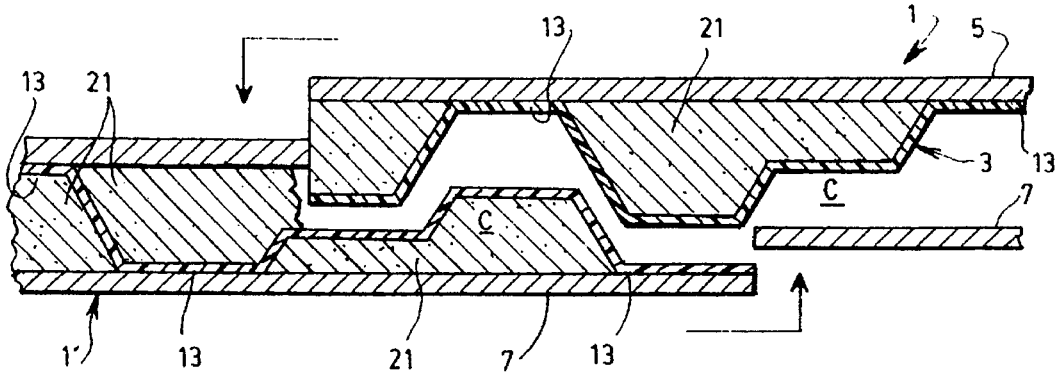
FIG. 3 is a side elevational, cross-sectional view showing the way two core-boards according to the invention as shown in FIG. 2 can rigidly be connected to each other by overlapping of their edges.

The core-board 1 according to the invention as shown in FIGS. 2 and 3 of the accompanying drawings, comprises, like all the known core-boards, a core 3 sandwiched between a pair of opposite skins 5, 7 that are parallel to each other.

The skins 5, 7 can be made of metal, wood or plywood, depending on the intended use of the core-board 1. The core 3 is preferably made of a composite material consisting of a thermoset resin incorporating a reinforcing material such a fabric of woven fibers that are ortho- or isotropically oriented. As non-restrictive examples of thermoset resin, reference can be made to polyester resin, epoxy resin or phenolic resin. As fabric, use can be made of any fabric made of glass fibers, carbon fibers or Kevlar®, which has its fibers oriented in such a manner as to extend perpendicular to the edges of the base of each cell, as is schematically shown on one of the cells of the core shown in FIG. 4. For this purpose, such fabric preferably contains fibers extending along three different directions at 60° with respect to each other. Alternatively, the fibers may be positioned directly within the mold so as to extend in the preselected direction. Examples of fabrics having such properties are sold by BRUNSWICK TECHNOLOGIES of Maine, ADVANCED TEXTILES of Pennsylvania and J. B. MARTIN of Quebec.

In some cases where a high specific resistance is required, prepeg fabric can be used. All of these materials are well known per se and commonly used for the manufacture of skins of core-boards. Accordingly, it is believed that no further explanation should be given on this matter. If required, one or both of the skins 5, 7 may have a texturized outer surface (see 23 in FIG. 2) to make it non slippery.

Figure 4:
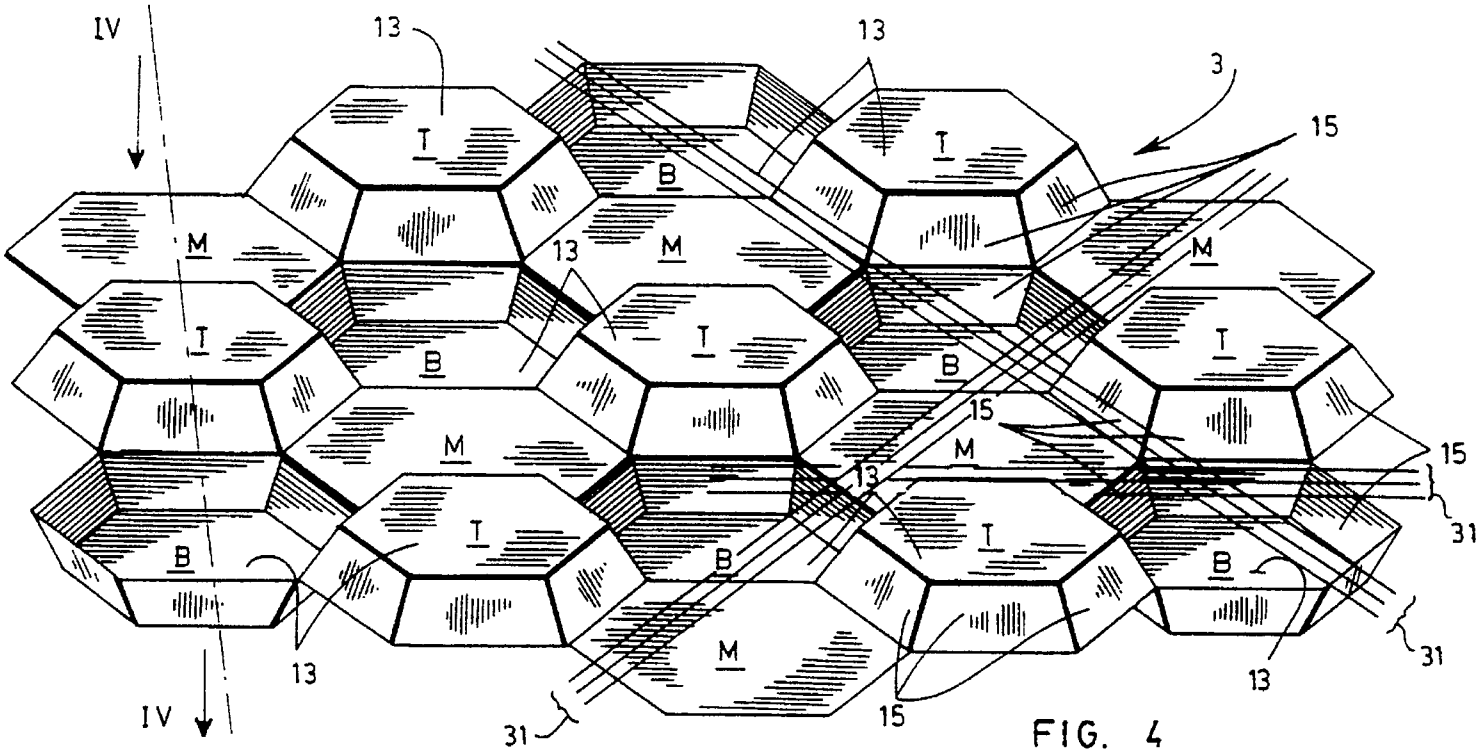
FIG. 4 is a partial perspective view of the core of the core-boards shown in FIGS. 2 and 3.
Figure 5:
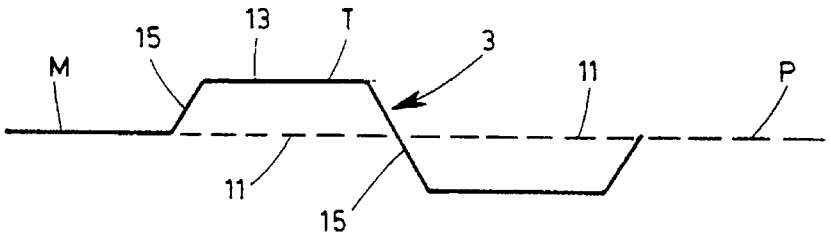
FIG. 5 is a side elevational, cross-sectional view of the core shown in FIG. 4, taken along line IV—IV.

As is better shown in FIGS. 4 and 5, the core 3 consists of an embossed sheet of light weight material which is preferably made by compression molding of a composite material consisting of a thermoset resin incorporating a reinforcing material such as a fabric of woven or unwoven fibers. Such fabric is preferably selected to allow proper positioning of its fibers when the core is molded. It is worth mentioning that other light weight material such as aluminum, wood particles or rigid plastic material could also be used, depending on the amount of stiffness and compression resistance that is required.

The core 3 which is preferably made by compression molding, comprises a central surface M extending in a plane P. It also comprises a plurality of embossments T hereinafter called "top cells", that are identical in shape and project from the central surface M on one side thereof. It further comprises another plurality of embossments B hereinafter called "bottom cells", that are identical in shape and project from the central surface M in a direction opposite to the top cells T.

Preferably, the top and bottom cells T and B are identical in size and height, so that the central surface M extends at mid-distance between the top surfaces of the top cells T and the top surfaces of the bottom cells B (see FIG. 5). Such equality in size and height is interesting since it makes the core symmetrical with respect to the plane P and thus as resistant and efficient on one side as on the other side. Equality, however, is not compulsory and the core could have top cells T different in size and height from the bottom cells B, if symmetry is not an issue.

As can be seen, each of the top and bottom cells T and B is integral to the central surface M, and of pyramidal shape. Each cell has an open base 11 of regular hexagonal shape extending in the plane P. It also has a top flat surface 13 that is also of regular hexagonal shape and of a smaller surface area than the base 11. The top fiat surface 13 of each cell extends parallel to the plane P and six tapering side surfaces 15 join the edges of this top surface 13 to the edges of the corresponding base 11 extending in the plane of the central surface M. As is shown, the bases 11 of the top and bottom cells T and B are of the same size. As is best shown in FIG. 4, the top and bottom cells T and B are regularly distributed onto the central surface M in such a manner that each top cell T is not adjacent to another top cell T but extends edge-to-edge to three spaced apart bottom cells B. Similarly, each bottom cell B is not adjacent to another bottom cell B but extends edge-to-edge to three spaced apart top cells T. Thus, each of the top and bottom cells T and B are spaced apart from the other top and bottom cells by portions of the central surface M that are of hexagonal shape and of the same size as the bases 11 of the top and bottom cells T and B.

Preferably, each pair of top and bottom cells T and B that extend edge-to-edge, have their adjacent tapering side surfaces 15 that extend in a same plane.

As is shown in FIGS. 2 and 3, the core 3 of the core-board 1 is rigidly connected to the opposite skins 5, 7 by fixation of the top surfaces 13 of the top and bottom cells to the opposite skins, respectively. Such fixation may be achieved by gluing, as is shown in FIG. 3. Alternatively, it can be achieved by any other method such as spot-welding or by means of rivets, screws or bolts 17 passing through the adjacent skins 5, 7 and threaded into receiving blocks 19 extending within the adjacent cells, in contact with the top surface 13 of thereof. Preferably, the blocks 19 are hexagonal and of a size similar to the one of the top surfaces of the cells T and B, so as to fit into and be "locked" within the same. Such blocks 19 which allows the tension stress to be equally distributed onto all the tapering side surfaces, can be slid into position along one of the passages defined by the cells on one side of the central surface, as will be better explained hereinafter. Alternatively, such blocks 19 can be prepositioned while the core-board is manufactured and "found" whenever required by means of a template especially designed for this purpose.

As is also shown in FIGS. 2 and 3, the core 3 and the opposite skins 5, 7 define together cavities "C" that can be filled up during or after the manufacture of the core-board with an insulating material, such as, for example, a syntactic foam 21 (see FIG. 3).

As is further shown in FIGS. 2 and 4, the very specific positions of the cells of each category (viz. top or bottom) that are never adjacent to each other, leave a plurality of straight passages extending parallel in a plurality of angular directions above and under the central surface M, in which reinforcing rods or cable or wire-receiving tubes 31 can be inserted either during manufacture of the core-board (viz. before the skins 5, 7 are connected to the core 3) or after manufacture or installation.

In accordance with a particularly interesting embodiment of the invention which is intimately related to the structure of the core 3, anchoring means of conventional structure can very easily be incorporated into the core-board 1 at any desired location, thereby making the latter very convenient to adapt to an existing structure.

As shown in FIG. 2, these anchoring means preferably comprises a T-shaped insert 25 that can be in the form of an internally threaded tube devised to receive a bolt. This insert 25 is introduced into a hole 27 made in one of the skins at any desired location. The insert 25 that may pass or not through the core 3, is held in position by a spot of a thermoset resin 28, preferably a syntactic foam injected into the core 3 so as to embed the insert and to bear against its lateral projections 26 in order to lock it rigidly. To make it sure that the insert 25 is fully embedded, cuts 29 can be made in the core with a tool through the hole 27 before injecting resin or syntactic foam resin 28, to ensure that the latter extends on both sides of the core 3 within the core-board. In practice, it is not compulsory that the insert 25 extends over the full thickness of the core 3. As a matter of fact, the length of the insert 25 may be optimized so as to be short enough to reduce as much as possible the formation of thermal bridges, but long enough to ensure good surface adhesion with the resin or syntactic foam 28.

In accordance with another particularly interesting embodiment of the invention which can be implemented when the top and bottom cells T and B of the core are identical in size and height, one can easily yet rigidly assemble one core-board 1 with at least one other core-board 1' of identical structure (see FIG. 3) in such a manner that these core-boards 1, 1' are co-planar. Such assembly can be achieved by removing a given width of the skin 7 of the core-board 1 and the same width of the skin 5 of the core-board 1' (or vice-versa) adjacent the edges thereof that are to be connected. Then, the uncovered part of the core 3 of the core-board 1 can be overlapped with the uncovered part of the core 3 of the adjacent core-board 1'. As aforesaid, such overlapping can be obtained by removing a corresponding part of one of the skins of one core-board to give access to the core 3 of this one core-board, and removing another corresponding part of the opposite skin of the adjacent core-board to give access to the core of the adjacent core-board. Of course, the removed parts of the one and adjacent core-boards 1, 1' must be sized and shaped to provide the resulting assembly with uninterrupted surfaces. Fixation of the uncovered parts of the cores of the core-boards 1, 1' can be achieved by gluing or by any other means known per se such as simultaneously nailing or screwing onto an adjacent bearing structure.

Figure 6:
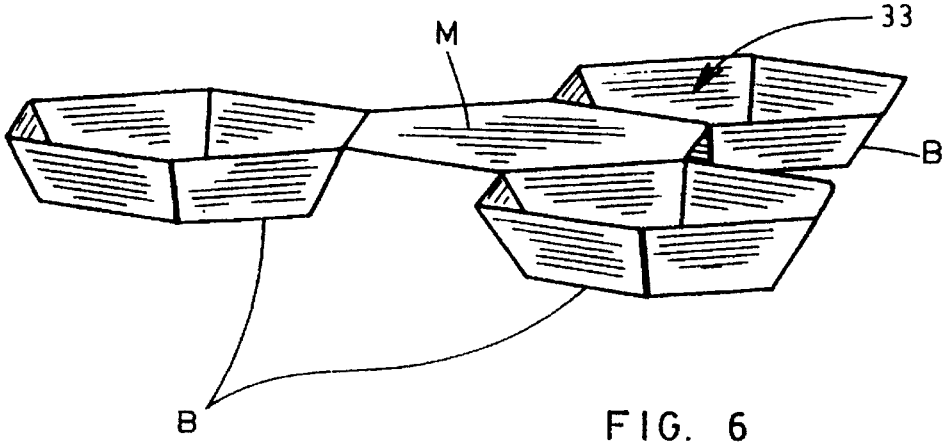
FIG. 6 is a perspective view of a joining module for use to connect adjacent core-boards according to the invention edge-to-edge.

Instead of proceeding to such an overlapping of the edges of the cores of two adjacent core-boards in order to structurally connect the same, use can be made of small joint modules 33 like the one shown in FIG. 6, having three or more cells of a given category, for example B, extending around one or more hexagonal central surfaces M. Such a module can be used to connect up three or more adjacent core-boards of hexagonal shape edge-to-edge. Advantageously, the thickness of the modules 33 can be selected to avoid any discrepancy in the level of the skins of the adjacent core-boards, once the sames are connected.

In use, fixation of the core-board according to the invention onto a supporting structure can be achieved in numerous ways. One of these ways consists in inserting inserts 25 into the core-board 1 as was explained hereinabove and using these inserts to anchor the core-board to the structure. Two other ways of achieving the same results are shown for way of examples only, in FIGS. 7 and 8.

Figure 7:
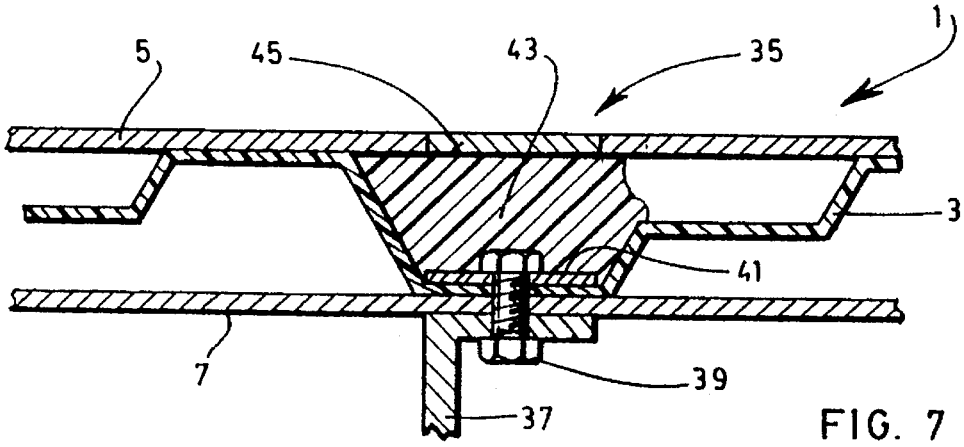
FIGS. 7 and 8 are side elevational, cross-sectional views showing two ways the core board according to the invention can be connected to a supporting truss.

In the embodiment shown in FIG. 7, a small opening 35 is provided in the upper skin 5 of the core-board, just above the truss 37 to which the core-board must be connected. Then, the core-board may be attached with a screw, bolt or rivet 39 whose head bears against a hexagonal washer 41. Of course, the small opening may be closed with a resin 43 and a small covering patch 45 after connection to the truss.

Figure 8:
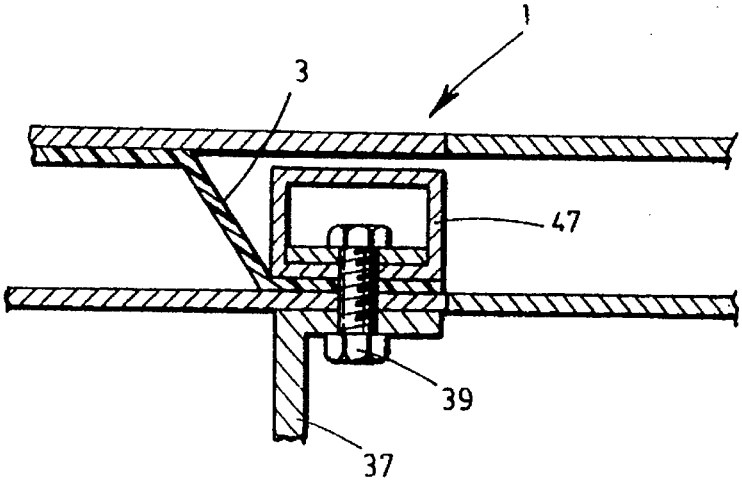

In the other embodiment shown in FIG. 8, the core-board is connected to the truss 37 by means of a bolt or screw 39 screwed into a hollow profile 47 containing a reinforcing metal plate, that can be inserted into the core 3. Such a screwing is carried out from under the truss 37 (see the position of the head of the screw 39).

Of course, numerous other ways of achieving the requested connection could be reduced to practise, depending on the user's needs.

As can be noticed, the core 3 according to the invention has a tridimensional geometry. The size of its cells and its overall thickness may vary depending on the strength and overall thickness that are wanted for the core-board.

The three-dimensional geometry and stability of the core 3 give to the core-board 1 a very high torsion resistance.

The truncated pyramidal shape of the cells of the core 3 also gives the core-board 3 a very high shearing resistance.

Due to the very particular shape and position of the cells, several core-boards 1, 1' can be connected to each other by mere overlapping of their adjacent edges, in such a manner that they extend in the same plane. This advantageously gives to the connection the same structural strength as the remaining parts of the core-boards.

The hexagonal shape of the pyramidal cells is also particularly interesting since it reduces to a minimum extent the "surface density" of the core 3 (i.e. its weight for a given amount of effective surface).

Moreover, the very specific geometry of the core 3 allows the core-board 1 to be filled up with an insulating foam whenever required during or after the manufacture of the core-board.

Thanks to its hexagonally shaped, pyramidal cells, the core 3 is resistant to compression and shear in almost all directions. Its structure allows the insertion of inserts 25 at any required locations over its surface. Such inserts 25 reinforce the mechanical connection between the core 3 and the skins 5, 7 of the core-board 1 and thus create a structural "link" between the two opposite faces of the skins, even if these inserts do not pass through both of said skins 5, 7. Indeed, in all cases, the core 3, thanks to its structure, allows transfer of the load from one skin to the other. Such strong mechanical connection is particularly interesting when the core-board is used as a flooring for a railroad wagon. In this connection, the core-board 1 according to the invention can be compared to a multidirectional truss. Accordingly, the core-board according to the invention can be said to be of modular truss-core construction.

The fact that it is impossible to move the core 3 with respect to the opposite skins 5, 7 in any direction when these elements are connected to each other is unique. Indeed, the core-board cannot be torn out even when the load applied thereto in flexion or torsion is high.

Last of all, due to the very specific position of the top and bottom cells on both sides of the core 3, no thermal bridge is created even when inserts 25 are used. This particular feature allows structural continuity between the skins of the core-board without simultaneously creating thermal bridges.

Thus, in summary, the main advantages of the core-board according to the present invention are as follows:

total load transfer between the opposite skins;

maximum and uniform load transfer between the skins (hexagonal pattern);

facility of assembly (bonding, riveting, screws);

possibility to vary the core-board strength without affecting the geometry (wall thickness);

module sections can be structurally assembled end-to-end;

high thermal resistance (no thermal bridge);

low density (comparable to Balsa);

optimization of hexagonal pattern for uniformity of load distribution;

properties in plane tri-axis;

high torsional strength (assembled panel);

possibility to install tubular rod or cables through the core;

compatibility making it possible to install the panel on almost unlimited support span (center to center of hexagonal pyramid);

facility of insert installation (hexagonal pattern);

possibility to interconnect structurally the sandwich cores (end-to-end);

compatibility of the core with a large variety of skin materials (stainless steel, aluminium, FRP . . .);

possibility to inject or cast insulating foam thru the sandwich core (higher thermal resistance).

EXAMPLE

In order to prove the efficiency of the core-board according to the invention different tests were carried out on core-boards like the one shown in FIG. 2, having a core made by compression molding of a glass fiber-reinforced polyester (FRP) and skins of different material. The tested core-boards had the following characteristics:

| | |
|---|---|
| total thickness: | 31 mm (1.20 inches) |
| thickness of the core: | 2.5 mm |
| thickness of each skin: | 3 mm |
| weight of the skins per square foot | |
| aluminum | 6.65 kg/m$^2$ (1.3 lbs/ft$^2$) |
| stainless steel | 20 kg/m$^2$ (4.0 lbs/ft$^2$) |
| FRP | 5 kg/m$^2$ (1.0 lbs/ft$^2$) |
| weight of the core per cubic foot: | 100 kg/m$^3$ (7 lbs/ft$^3$) |

Flexural Strength (a) Tests were carried out according to the ASTM D790 standards on a FRP-laminated core-board as disclosed hereinabove, having a support span equal to 457 mm and a width equal to 225 min. The results that were obtained are as follows:

TABLE I

| load kN | deflexion mm | maximum constraint MPa | elasticity modulus MPa |
|---|---|---|---|
| 10.89 | 6.50 | 23.56 | 5745 |

(b) The same tests carried out on the same kind of core-board whose skins were connected to the core by means of bolts, gave the following results:

TABLE II

| load kN | deflexion mm | maximum constraint MPa | elasticity modulus MPa |
|---|---|---|---|
| 11.49 | 10.57 | 24.96 | 5642 |

(c) Other tests were carried out according to the ASTM C 393 standards on a FRP-laminated core-board as used in step (a). The results that were obtained are as follows:

TABLE III

| core shearing strength MPa | outer panel flexion constraint MPa |
|---|---|
| 0.86 | 32.91 |

Compression Strength

Tests were carried out on a FRP laminated core-board as used in step (a), in order to determine the compression strength of this core when a load is applied onto a hexagonal portion of it including seven pyramid-shaped cells.

TABLE IV

| applied load kN | resisting surface cm$^2$ | unitary constraint MPa |
|---|---|---|
| 64.35 | 176.6 | 3.65 |

Insert Tear-Out Resistance

Tests were also carried out on a core-board as disclosed hereinabove having a core 2.5 mm thick. The skins were 1 mm thick and each made of aluminum. They were attached to the core by means of bolts. Metal inserts were mounted into the core-board and held in it which a syntactic foam as was disclosed in the above specification.

These tests have shown that a load of at least 550 kg was required to break the syntactic foam and cause shearing of the adjacent aluminum skin.

As can be noticed, the flexural strength of the core-board according to the invention is very good. As a matter of fact, its maximum constraint is similar to the one of a core-board of the same thickness whose core is made of PVC while its elasticity modulus is similar to the one of a core-board of the same thickness whose core is made of balsa. This maximum constraint remains almost unchanged when the outer skins are bolted to the core or just laminated on it.

The compression resistance of the core-board according to the invention is also very good. As a matter of fact, it ranges between the compression resistances of similar core-boards whose cores are made of PVC (unitary constraint: 1.99 MPa) and Balsa (unitary constraint: 7.95 MPa).

The insert tear-out resistance is very high and almost identical to the thread resistance of the insert. This is indicative that the anchoring of the insert with a syntactic foam is excellent.

Of course, numerous obvious modifications could be made to the above described embodiment of a core-board according to the invention within departing from the scope of the present invention as defined in the appended claims.

We claim:

1. A core for use in a core-board, said core consisting of an embossed sheet of a light weight material comprising:

a central surface extending in a plane;

a plurality of embossments hereinafter called "top cells", that are identical in shape and project from said central surface on one side thereof; and another plurality of embossments hereinafter called "bottom cells", that are identical in shape and project from the central surface in a direction opposite to said top cells;

wherein:

each of said top and bottom cells is integral to said central surface and of pyramidal shape and has an open base of regular hexagonal shape extending in the plane of said central surface, a top flat surface that is of regular hexagonal shape and of a smaller surface area than said base, said top flat surface extending parallel to said plane, and six tapering side surfaces joining the top surface to the central surface, the bases of said top and bottom cells are of a same size; and said top and bottom cells are regularly distributed onto said central surface in such a manner that each top cell is not adjacent to another top cell but extends edge to edge to three spaced apart bottom cells, and each bottom cell is not adjacent to another bottom cell but extends edge to edge to three spaced apart top cells, each of said top and bottom cells thus being spaced apart from the other top and bottom cells respectively by portions of said central surface that are of hexagonal shape and of the same size as the bases of said top and bottom cells.

2. A core as claimed in claim 1, wherein said top and bottom cells are identical in size and height, whereby said central surface extends at mid-distance between the top surfaces of said top cells and the top surfaces of said bottom cells.

3. A core as claimed in claim 1, wherein each pair of top and bottom cells that extend edge-to-edge have their adjacent tapering side surfaces that extend in a same plane.

4. A core as claimed in claim 1, wherein said core is made of composite material and produced by compression molding.

5. A core as claimed in claim 4, wherein said composite material includes a reinforcing material consisting of woven fibers.

6. A core as claimed in claim 4, wherein each pair of top and bottom cells that extend edge-to-edge have their adjacent tapering side surfaces that extend in a same plane.

7. A core as claimed in claim 4, wherein said top and bottom cells are identical in size and height, whereby said central surface extends at mid-distance between the top surfaces of said top cells and the top surfaces of said bottom cells.

8. A core as claimed in claim 7, wherein said composite material includes a reinforcing material consisting of woven fibers.

9. A core-board comprising a core sandwiched between a pair of opposite skins parallel to each other, wherein said core is as defined in claim 1 and is rigidly connected to the skins by fixation of the top surfaces of its top and bottom cells to said skins, respectively.

10. A core-board as claimed in claim 9, wherein said opposite skins are fixed to the top surfaces of the top and bottom cells by gluing.

11. The core-board as claimed in claim 9, wherein said core and skins defines cavities therebetween that are filled up with an insulation material.

12. A core-board as claimed in claim 9, wherein at least one of said skins has a texturized outer surface.

13. A core-board as claimed in claim 9, further comprising at least one anchoring means integral thereto, said anchoring means comprising an insert introduced into a hole made in one of said skins at any desired location, said insert being held in position by a thermoset resin injected into the core so as to embed said insert.

14. A core-board as claimed in claim 9, in combination with at least one other core-board of identical structure, said core-boards being co-planar and connected to each other by overlapping of part of the core of one of said core-boards with part of the core of every adjacent core-board, such overlapping being obtaining by removal of a corresponding part of one of the skins of said one core-board to give access to the core of said one core-board, and removal of another corresponding part of the opposite skin of the adjacent core-board to give access to the core of said adjacent core-board, said removed parts of said one and adjacent core-boards being sized and shaped to provide the resulting combination with uninterrupted surfaces.

15. A core-board as claimed in claim 9, wherein:

said top and bottom cells are identical in size and height, whereby said central surface extends at mid-distance between the top surfaces of said top cells and the top surfaces of said bottom cells.

16. A core-board as claimed in claim 15, further comprising at least one anchoring means integral thereto, said anchoring means comprising an insert introduced into a hole made in one of said skins at any desired location, said insert being held in position by a thermoset resin injected into the core so as to embed said insert.

17. A core-board as claimed in claim 16, in combination with at least one other core-board of identical structure, said core-boards being co-planar and connected to each other by overlapping of part of the core of one of said core-boards with part of the core of every adjacent core-board, such overlapping being obtaining by removal of a corresponding part of one of the skins of said one core-board to give access to the core of said one core-board, and removal of another corresponding part of the opposite skin of the adjacent core-board to give access to the core of said adjacent core-board, said removed parts of said one and adjacent core-boards being sized and shaped to provide the resulting combination with uninterrupted surfaces.

* * * * *